US008265519B2

(12) United States Patent
Shikata

(10) Patent No.: US 8,265,519 B2
(45) Date of Patent: Sep. 11, 2012

(54) LID DEVICE AND IMAGE FORMING APPARATUS

(75) Inventor: Masahito Shikata, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 351 days.

(21) Appl. No.: 12/751,125

(22) Filed: Mar. 31, 2010

(65) Prior Publication Data

US 2011/0013931 A1 Jan. 20, 2011

(30) Foreign Application Priority Data

Jul. 17, 2009 (JP) ..... 2009-169307

(51) Int. Cl.
*G03G 15/00* (2006.01)

(52) U.S. Cl. ..... 399/107

(58) Field of Classification Search ..... 399/107, 399/110, 114, 120, 125, 258, 262; 222/DIG. 1; 49/322, 373; 248/213.1; 312/293.2
See application file for complete search history.

(56) References Cited

U.S. PATENT DOCUMENTS

| | | | | |
|---|---|---|---|---|
| 5,434,655 | A * | 7/1995 | Okamura | 399/119 |
| 5,815,379 | A * | 9/1998 | Mundt | 361/679.55 |
| 6,163,927 | A * | 12/2000 | Leu | 16/272 |
| 6,276,562 | B1 * | 8/2001 | Hodge et al. | 220/831 |
| 7,343,118 | B2 * | 3/2008 | Ahn et al. | 399/124 |
| 7,382,998 | B2 * | 6/2008 | Murrell | 399/107 |
| 2010/0078884 | A1 * | 4/2010 | Uehara | 271/314 |
| 2011/0205692 | A1 * | 8/2011 | Yamamoto | 361/600 |

FOREIGN PATENT DOCUMENTS

| | | |
|---|---|---|
| JP | A-5-116427 | 5/1993 |
| JP | A-2001-205895 | 7/2001 |
| JP | A-2004-306521 | 11/2004 |
| JP | A-2006-203777 | 8/2006 |

* cited by examiner

*Primary Examiner* — Robert Beatty
(74) *Attorney, Agent, or Firm* — Oliff & Berridge, PLC

(57) ABSTRACT

A lid device includes a main body, an opening/closing member, a support portion and a fall preventing member. The opening/closing member is attached to the main body so as to be opened and closed. The support portion is provided on the main body, and supports the opening/closing member in such a manner which the opening/closing member is disengaged from the main body when receiving force of opening the opening/closing member beyond a predetermined opening/closing angular range. The fall preventing member prevents the opening/closing member disengaged from the support portion from coming off the main body.

6 Claims, 7 Drawing Sheets

LID DEVICE AND IMAGE FORMING APPARATUS

CROSS-REFERENCE TO RELATED APPLICATION

This application is based on and claims priority under 35 USC119 from Japanese Patent Application No. 2009-169307 filed on Jul. 17, 2009.

BACKGROUND

Technical Field

The present invention relates to a lid device and an image forming apparatus.

SUMMARY

According to an aspect of the invention, a lid device includes a main body, an opening/closing member, a support portion and a fall preventing member. The opening/closing member is attached to the main body so as to be opened and closed. The support portion is provided on the main body, and supports the opening/closing member in such a manner which the opening/closing member is disengaged from the main body when receiving force of opening the opening/closing member beyond a predetermined opening/closing angular range. The fall preventing member prevents the opening/closing member disengaged from the support portion from coming off the main body.

BRIEF DESCRIPTION OF THE DRAWINGS

Exemplary embodiments of the invention will be described in detail based on the following figures, wherein.

DETAILED DESCRIPTION

Figure 1:
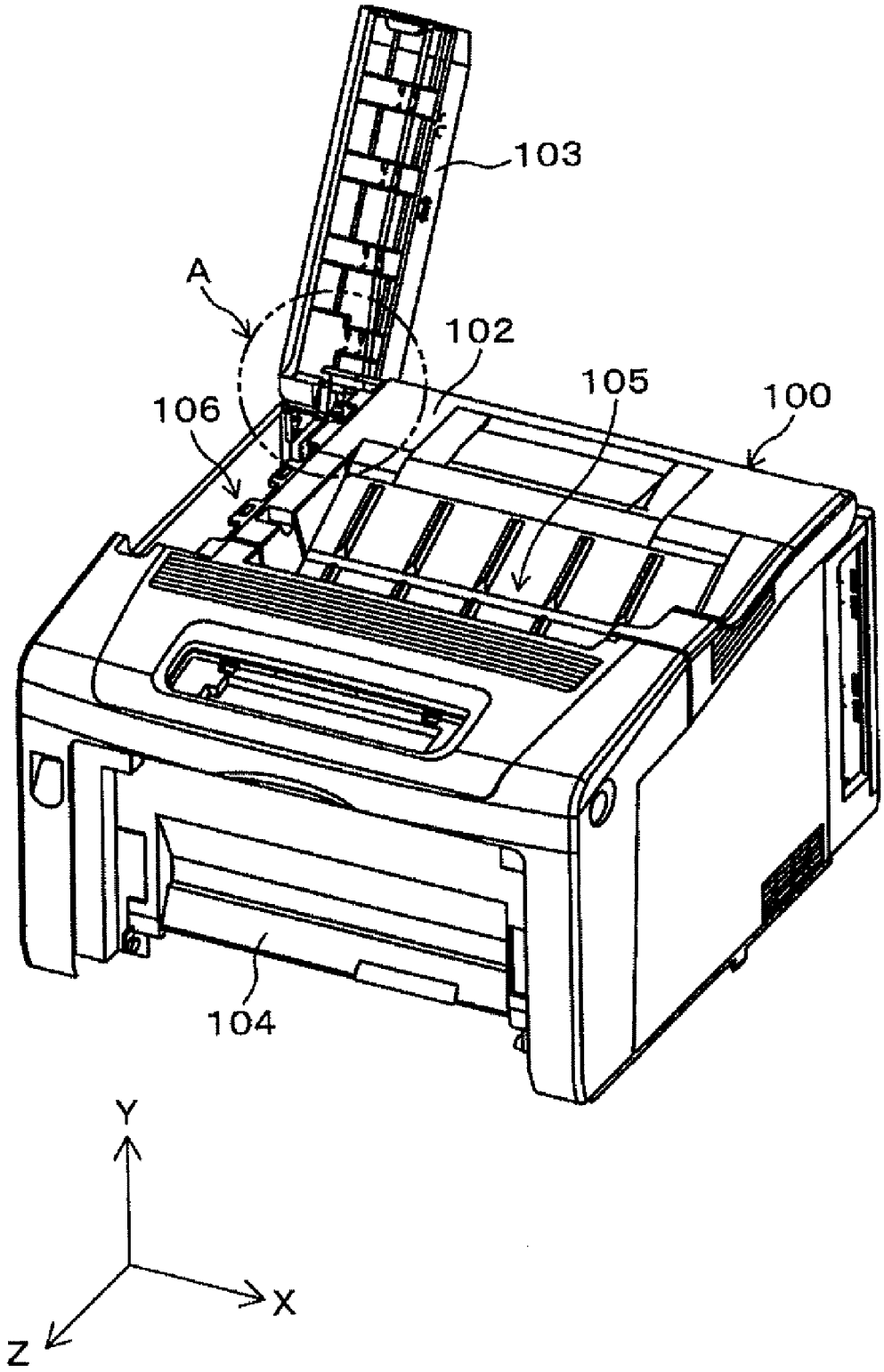
FIG. 1 is a perspective view of an image forming apparatus according to a first embodiment.

A first embodiment of the present invention will be hereinafter described. Meanwhile, in the drawings, a mark where "●" exists in a "○" means an arrow that faces the front side of the plane of paper in the drawing from the rear side thereof, and a mark where "×" exists in a "○" means an arrow that faces the rear side of the plane of paper in the drawing from the front side thereof.

FIG. 1 is a perspective view of an image forming apparatus 100 according to the first embodiment. The image forming apparatus 100 has a function of forming an image on a recording medium such as a paper medium on the basis of image data that is supplied externally and outputting the resulting recording medium. The image forming apparatus 100 is equipped with an opening/closing member 103 which is opened and closed with respect to a main body 102. The opening/closing member 103, which is a member to serve as a lid, is opened or closed by holding it with a hand and doing an opening or closing action.

The image forming apparatus 100 is equipped with a sheet housing tray 104 which can be drawn out. Images are formed inside the main body 102 on sheets (recording sheets) that are taken out of the sheet housing tray 104, and the image-formed sheets are ejected so as to be placed on a sheet ejection surface 105.

An opening 106 is formed when the opening/closing member 103 is opened. A toner bottle (not shown) is disposed inside the opening 106. Being detachable from the main body 102, the toner bottle is removed when the toner contained therein has been used up. And a new toner bottle is attached. To replace the toner bottle, the opening/closing member 103 is opened to enable access to the space inside the opening 106. In a situation that no access to the space inside the opening 106 is necessary, the opening/closing member 103 is closed to prevent entrance of foreign matter into the space inside the opening 106.

Figure 2:
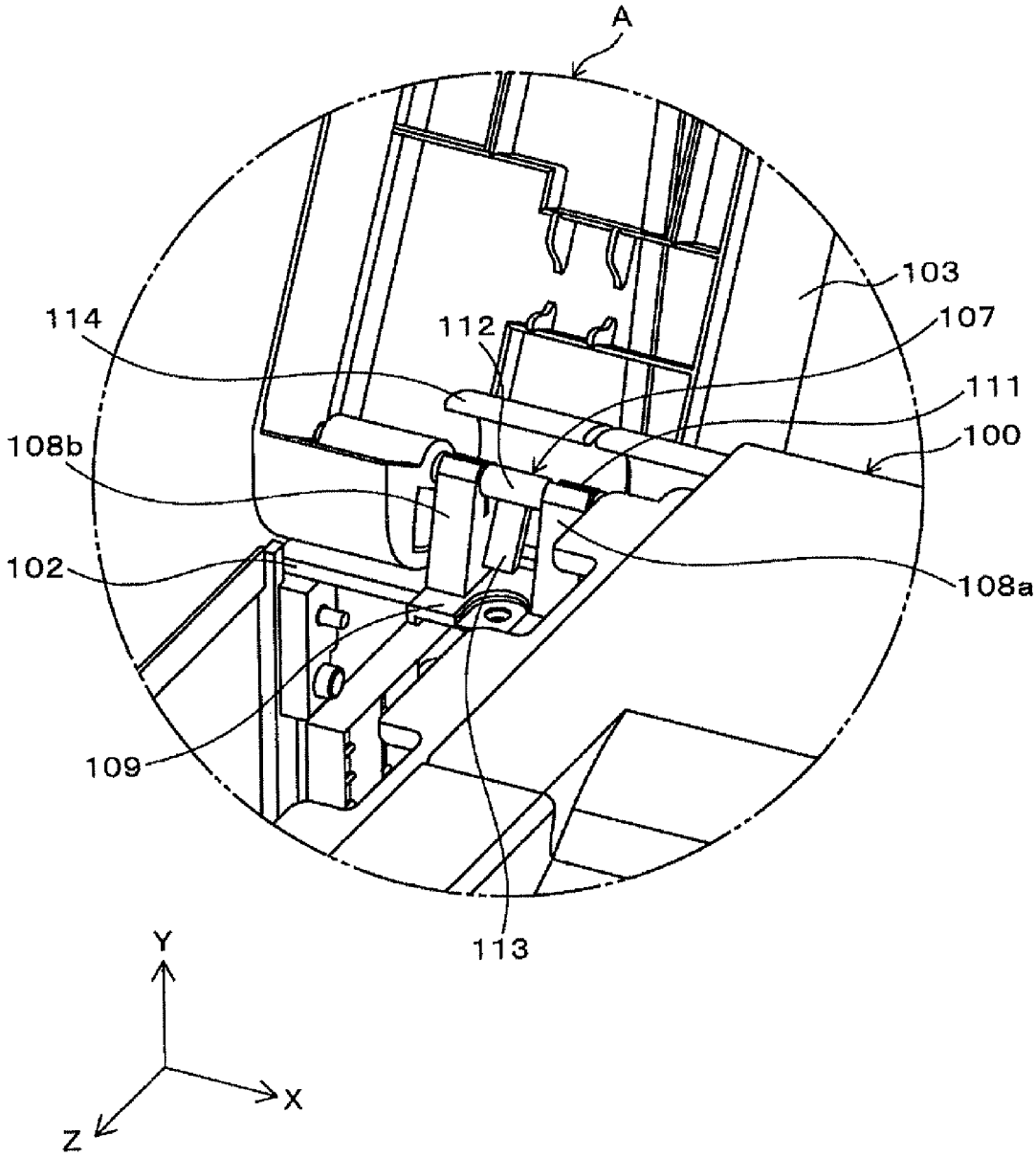
FIG. 2 is an enlarged view of part of FIG. 1.
Figure 3:
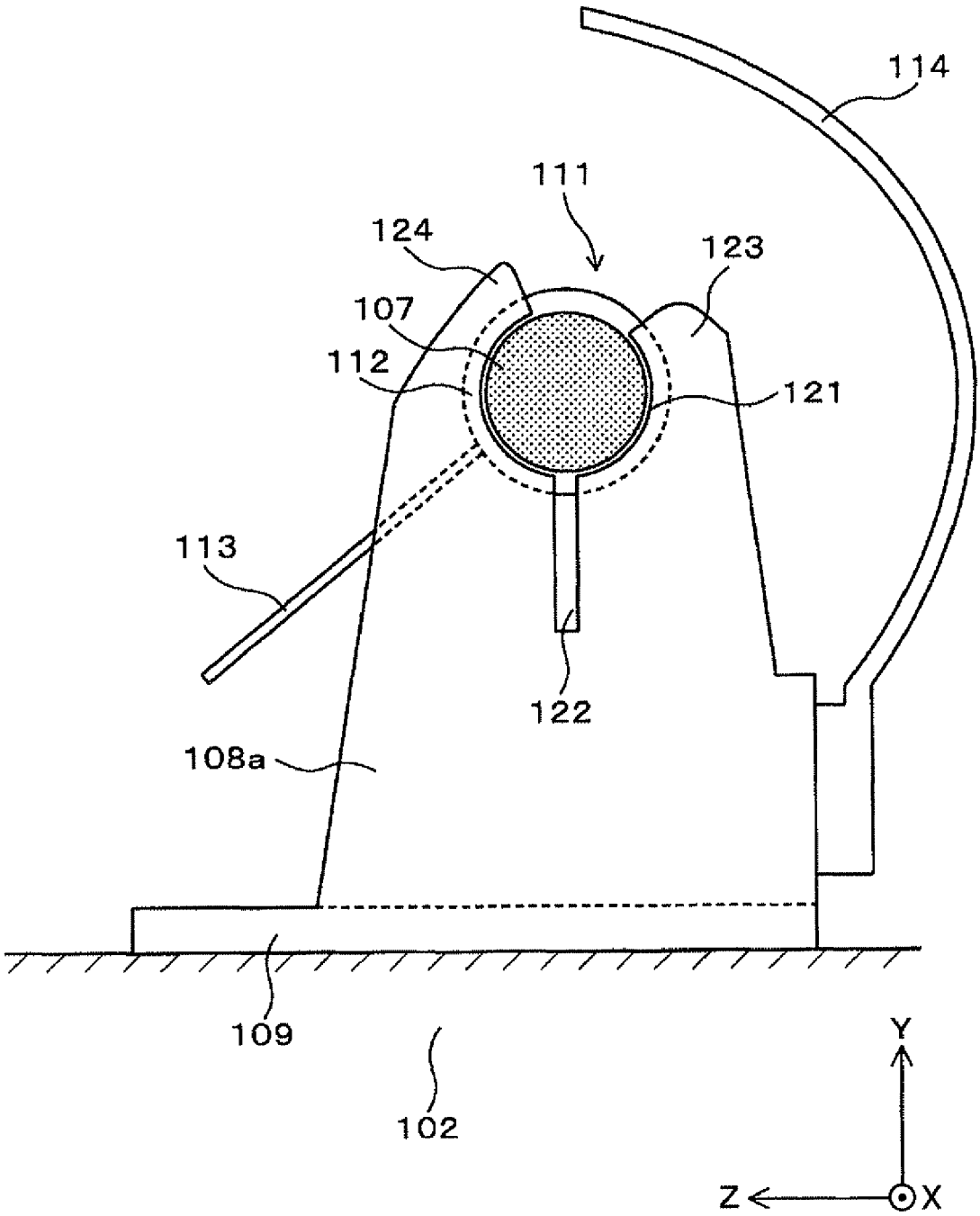
FIG. 3 is a conceptual diagram of part of FIG. 2.

FIG. 2 is an enlarged view of part A of FIG. 1. FIG. 3 is a conceptual diagram of part of FIG. 2 as viewed from the positive side of the X axis. FIG. 2 shows a structure of supporting the opening/closing member 103 in such a manner that the opening/closing member 103 can be opened and closed with respect to the main body 102. A shaft 107 which serves as a rotary shaft during an opening or closing operation is fixed to the opening/closing member 103. The shaft 107 is supported rotatably by shaft receivers 108*a* and 108*b* having the same structure. The shaft 107 is supported rotatably by the two shaft receivers 108*a* and 108*b* at two locations that are spaced from each other.

The shaft receivers 108*a* and 108*b* are made of resin and are integral with a base 109. The base 109 is fixed to the main body 102. The shaft receivers 108*a* and 108*b* will be described below. Since they have the same structure, only the shaft receiver 108*a* will be described below.

As shown in FIG. 3, a slit 111 is formed in a top portion of the shaft receiver 108*a* in an angular range including the direction of 120° as measured from the horizontal direction so as to extend in the axial direction of the shaft 107. A groove 121 for holding the shaft 107 is formed under the slit 111. The groove 121 extends in the X direction shown in FIG. 3 (i.e., the axial direction of the shaft 107) and has a cross section that conforms to the outer circumference (circle) of the shaft 107. With this structure, the shaft 107 can rotate being in contact with the inner circumferential surface of the groove 121 in a state that the shaft 107 is held by the groove 121. That is, a portion of the shaft receiver 108*a* that surrounds the groove 121 is cut out partially to form the slit 111.

A slit 122 is formed so as to extend downward from the bottom of the groove 121. Since the shaft receiver 108*a* is made of resin and the slit 122 is formed therein, when the shaft 107 is pressed against the slit 111 from above (from the positive side of the Y axis shown in FIG. 3), the slit 111 is deformed elastically and is extended in the right-left direction in FIG. 3. If the shaft 107 is further pushed down, it is put into the groove 121 which is located under the slit 111. The deformation of the slit 111 disappears and the shaft 107 is held rotatably by the shaft receiver 108*a*. FIGS. 2 and 3 show this state. Although the shaft receiver 108*a* has been described above, the shaft receiver 108*h* has the same function and also holds the shaft 107.

The shaft 107 has a portion 112 which is located between the shaft receivers 108*a* and 108*b* and has a larger outer diameter. The portion 112 functions as a slide preventing portion for preventing the shaft 107 from moving in the X-axis direction in a state that it is supported by the shaft receivers 108*a* and 108*b*.

A rotation preventing member 113 is attached to the slide preventing portion 112. The rotation preventing member 113 is a plate-like member which extends in the direction that is opposite to the direction in which the opening/closing member 103 extends. The rotation preventing member 113 has such a length as not to touch the base 109 when the shaft 107 is rotated in the state of FIG. 2. Therefore, in the state of FIGS. 2 and 3 in which the shaft 107 is supported by the shaft receivers 108*a* and 108*b*, the rotation preventing member 113 does not obstruct the rotation of the shaft 107. The function of the rotation preventing member 113 will be described later.

A fall preventing member 114 extends upward from the base 109 while curving so as to cover the shaft 107. The fall preventing member 114 is a member having a function of preventing a situation that when the shaft 107 is disengaged from the shaft receivers 108*a* and 108*b* the shaft 107 comes off the main body 103 and is rendered irrelevant to the latter. This function will be described later. The fall preventing member 114 is molded with resin together with the shaft receivers 108*a* and 108*b* and the base 109. Because of the elastic deformation function of the resin, the fall preventing member 114 can be deformed to some extent.

As shown in FIG. 3, the portions of the shaft receiver 108*a* that are located on the two respective sides of the slit 111 are not symmetrical in shape. More specifically, an edge portion 123 of the slit 111 located on the side of the fall preventing member 114 is lower than an edge portion 124 located on the opposite side. Furthermore, the shaft 107 is covered from above by the edge portion 123 in a smaller area than by the edge portion 124. The shaft receiver 108*b* has the same structure.

When the user performs an opening or closing action by holding the opening/closing member 103 with a hand in the state that the shaft 107 is held by the shaft receivers 108*a* and 108*b*, the shaft 107 is rotated while being in frictional contact with the shaft receivers 108*a* and 108*b* and the opening/closing member 103 is opened or closed with respect to the main body 102. The movable range (opening/closing range) of the opening/closing member 103 is from the closed position (horizontal position) to a position where the opening/closing member 103 is rotated by 120° from the closed position. The posture of the opening/closing member 103 is maintained at the 120°-rotated position (open position). Even if it is attempted to open the opening/closing member 103 further, part of the opening/closing member 103 contacts the main body 102 and the opening/closing member 103 cannot be moved further in the opening direction in a physical sense.

If excessive force is exerted on the opening/closing member 103 so as to open the opening/closing member 103 beyond the opening-side end of the opening/closing range, force of moving the shaft 107 upward occurs from under the slits 111 of the shaft receivers 108*a* and 108*b*. As a result, because of the elastic deformation function of the resin material of the shaft receivers 108*a* and 108*b*, the slits 111 are extended and the shaft 107 is disengaged from the shaft receivers 108*a* and 108*b*. That is, the shaft 107 is disengaged from the main body 102.

At this time, since as shown in FIG. 3 the top edge portions 123 and 124 above the groove 121 of each of the shaft receivers 108*a* and 108*b* are not symmetrical in sectional shape and the shaft 107 tends to be disengaged in the top-right direction in FIG. 3, the shaft 107 is guided toward the fall preventing member 114 when it is disengaged.

Figure 4:
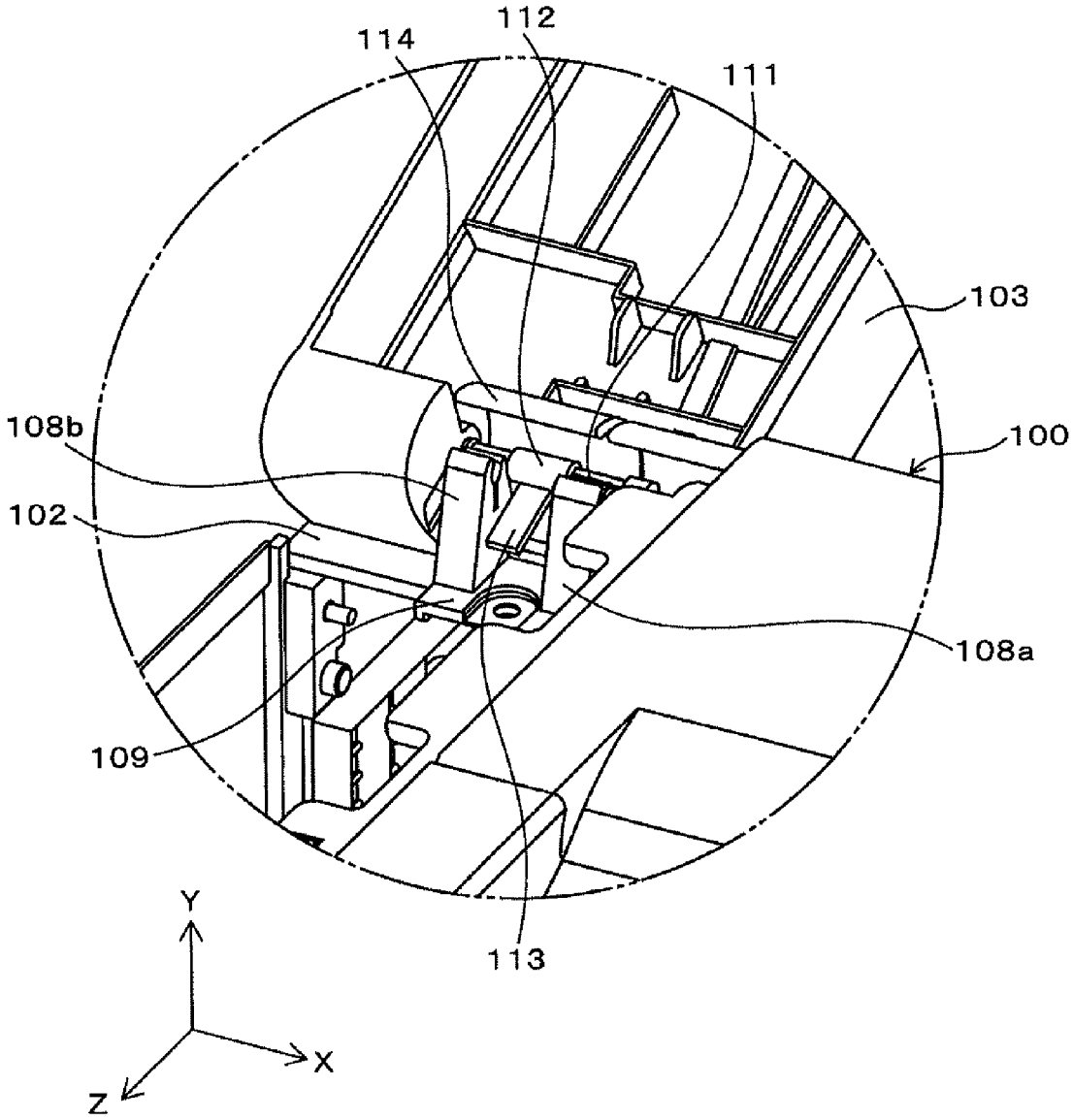
FIG. 4 is an enlarged view showing a state which a shaft is disengaged from shaft receivers.
Figure 5:
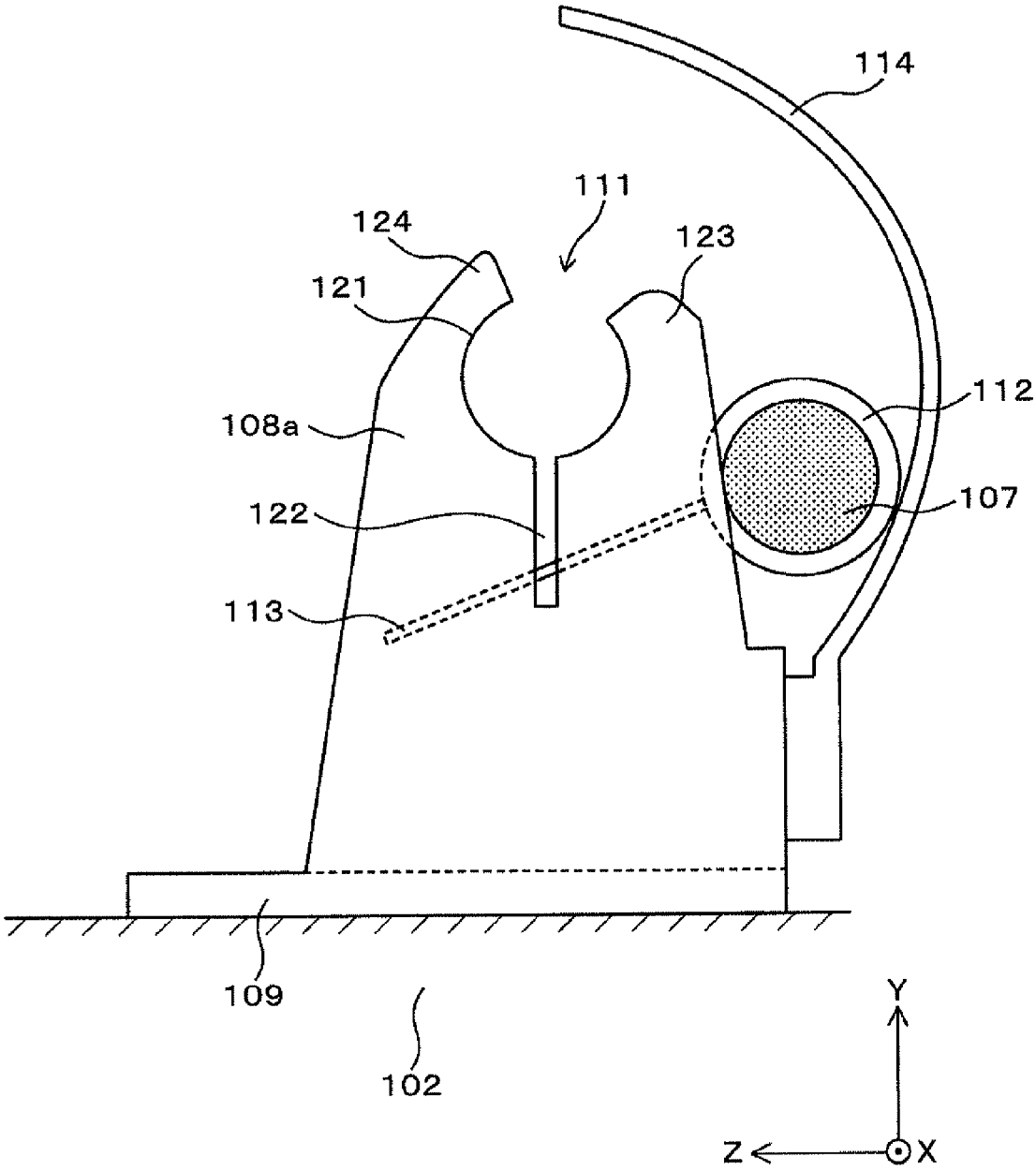
FIG. 5 is a conceptual diagram showing a state which a shaft is disengaged from shaft receivers.

The fall preventing member 114 is provided on the opening side from a position that is located on a straight line that starts from the rotation center of the shaft 107 and passes through the slit 111. The shaft 107 that has been disengaged from the shaft receivers 108*a* and 108*b* is received by the fall preventing member 114 and does not come off the main body 102. FIGS. 4 and 5 show this state. In this state, the shaft 107 is placed inside the fall preventing member 114 and hence does not come off the main body 102.

When the opening/closing member 103 is pushed forcibly by strong force in the opening direction beyond the opening/closing range, the shaft 107 is disengaged from the shaft receivers 108*a* and 108*b* and comes into contact with the fall preventing member 114 with strong momentum. Since the fall preventing member 114 is molded with the same resin material as and hence is integral with the shaft receivers 108*a* and 108*b*, when the shaft 107 comes into contact with the fall preventing member 114 with strong momentum, the fall preventing member 114 is deformed elastically by the impact and thereby absorbs the pushing force.

To restore the state that the shaft 107 is supported by the shaft receivers 108*a* and 108*b* (i.e., the original state of FIGS. 1-3) from the state of FIGS. 4 and 5, the shaft 107 is brought into contact with the slits 111 of the shaft receivers 108*a* and 108*b* and then downward force is applied to the shaft 107. The slits 111 are deformed elastically, whereby the shaft 107 is caused to pass through the slit 111 and to be held by the grooves 121. The state of FIGS. 1-3 is thus established.

If it is attempted to close the opening/closing member 103 in the state of FIGS. 4 and 5, the shaft 107 is rotated counterclockwise (as seen in FIG. 5). However, since the rotation preventing member 113 touches the base 109, the opening/closing member 103 cannot be rotated further in the closing direction, that is, it cannot be closed. That is, the opening/closing member 103 cannot be closed in the state that the shaft 107 is disengaged from the shaft receivers 108*a* and 108*b*.

To close the opening/closing member 103 from the state of FIGS. 4 and 5, it is necessary to re-establish the state of FIGS. 1-3. Once the state of FIGS. 1-3 is re-established, the rotation preventing member 113 does not touch the base 109 even if the user performs an action of closing the opening/closing member 103. The opening/closing member 103 can be closed normally.

When it is attempted to forcibly open the opening/closing member 103 beyond the preset movable range, the shaft 107 is disengaged from the shaft receivers 108*a* and 108*b*. This prevents the shaft 107 and the shaft receivers 108*a* and 108*b* from being damaged.

The shaft 107 that has been disengaged from the shaft receivers 108*a* and 108*b* is received by the fall preventing member 114 and thereby prevented from coming off the main body 102. This prevents the opening/closing member 103 from being lost. In many cases, the image forming apparatus 100 is placed on a desk. In such a situation, an event can be prevented that the opening/closing member 103 is damaged because it falls off the image forming apparatus 100 and collides with the floor.

Even if it is attempted to open the opening/closing member 103 forcibly by strong force and the shaft 107 is pressed against the fall preventing member 114 with strong momentum, the force is absorbed through elastic deformation of the fall preventing member 114 which is made of resin. This prevents an event that such a forcible action damages the shaft 107, the fall preventing member 114, or the structure that supports the fall preventing member 114.

In the state that the shaft 107 is disengaged from the shaft receivers 108*a* and 108*b* (i.e., the state of FIGS. 4 and 5), the rotation preventing member 113 obstructs rotation of the shaft 107 in the closing direction (counterclockwise rotation (as viewed in FIG. 5)). As a result, the opening/closing member 103 is prevented from being rotated in the closing direction in the state that the shaft 107 is disengaged from the shaft receivers 108*a* and 108*b*.

The fall preventing member 114 does not cover the entire circumference of the shaft 107. Therefore, work of attaching the shaft 107 to the shaft receivers 108*a* and 108*b* can be performed by passing the shaft 107 through a space where the fall preventing member 114 does not exist. Also in replacing the opening/closing member 103 because, for example, it has been damaged, work of removing and attaching the shaft 107 can be performed by utilizing a space where the fall preventing member 114 does not exist.

Figure 6A:
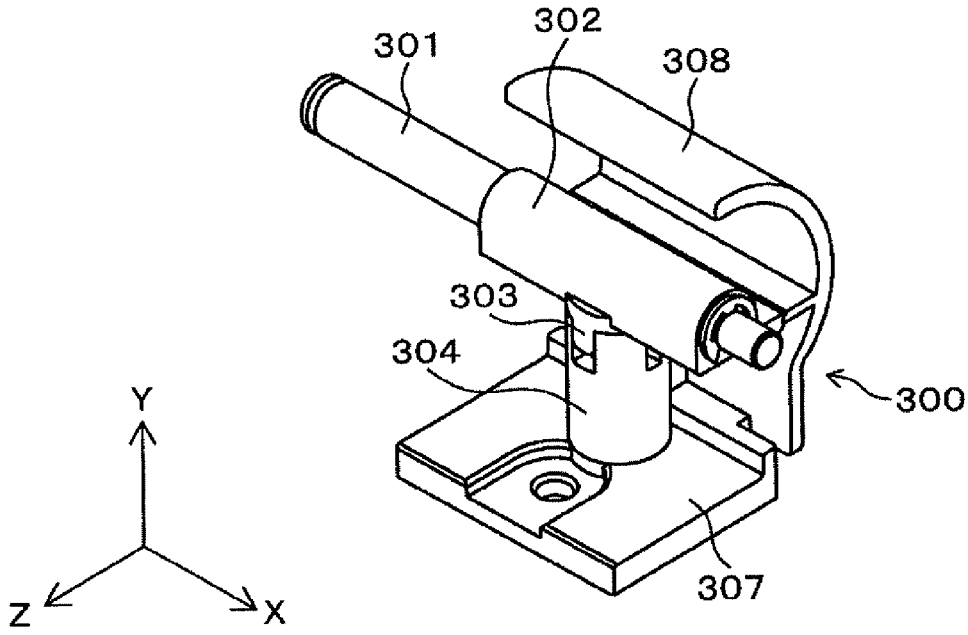
FIGS. 6A and 6B are perspective views showing another shaft supporting structure.
Figure 6B:
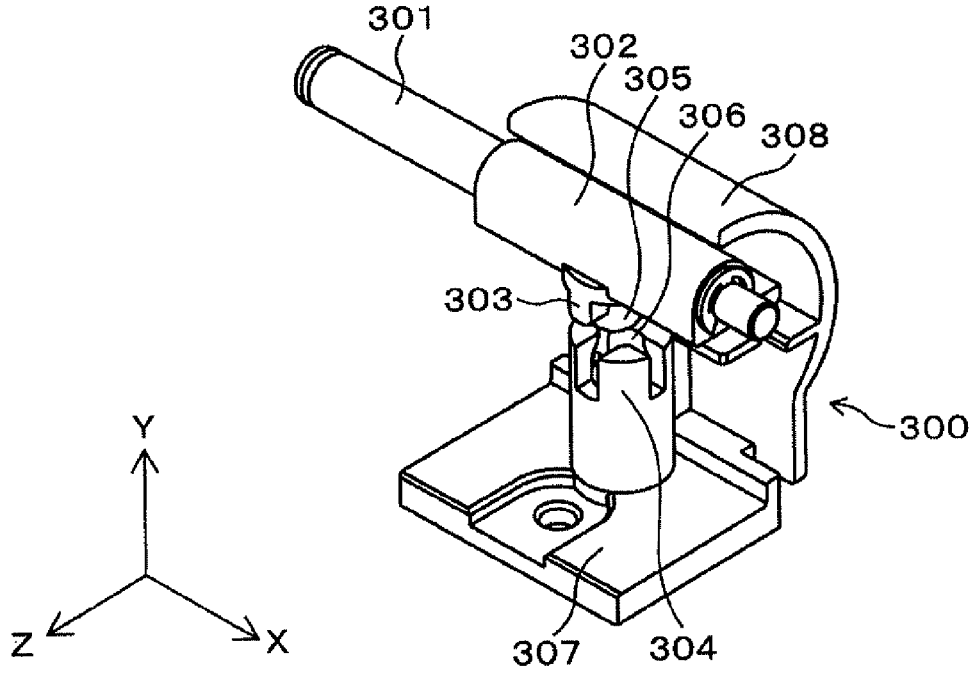

Another shaft supporting structure will be described below. FIGS. 6A and 6B show a supporting structure 300 for a shaft 301 of the opening/closing member 103 (see FIGS. 1 and 2). FIG. 6A shows a state that the shaft 301 is attached to a support portion, and FIG. 6B shows a state that the shaft 301 is detached from the support portion.

The shaft 301, which corresponds to the shaft 107 shown in FIGS. 2 and 3, is fixed to the opening/closing member 103 (not shown in FIGS. 6A and 6B). In the state of FIG. 6A, the shaft 301 is held rotatably by a shaft holding member 302. A convex fitting member 303 is fixed to a bottom portion of the shaft holding member 302.

The convex fitting member 303 has projections which are formed radially at four angular positions that are spaced from each other by 90° when viewed from the negative side in the Y axis. A spherical portion 305 is formed at the center of the convex fitting member 303. The convex fitting member 303 is fixed to the main body side through coupling with a concave fitting member 304.

The concave fitting member 304 is made of resin and shaped so as to be fitted with the convex fitting member 303. A recess 306 to be fitted with the spherical portion 305 is formed at the center of the fitting portion of the concave fitting member 304. The inner dimension of a top portion of the recess 306 is smaller than the diameter of the spherical portion 305. If the convex fitting member 303 is pushed down and the spherical portion 305 is pressed against the concave fitting member 304 in the state of FIG. 6B, the spherical portion 305 extends the top portion of the concave fitting member 304 and is fitted into the recess 306. As a result, the state of FIG. 6A is established.

A bottom portion of the concave fitting member 304 is fixed to a base 307 which is made of resin. The base 307 is fixed to the cabinet of an image forming apparatus (not shown). A fall preventing member 308, which is molded with resin together with the base 307, is thus fixed to the base 307. The fall preventing member 308 has the same role as the fall preventing member 114 shown in FIGS. 2 and 3.

A description will now be made of an operation in a case that it is attempted to open the opening/closing member 103 (not shown in FIGS. 6A and 6B) further beyond its movable range. In this case, when force that is stronger than a certain level is applied, the spherical portion 305 is disengaged from the recess 306 and the convex fitting member 303 is disengaged from the concave fitting member 304. At this time, the fall preventing member 308 prevents the shaft 301 from coming off the apparatus main body as in the case of FIGS. 4 and 5.

In the supporting structure of FIGS. 6A and 6B, coupling is made by fitting the spherical portion 305 into the recess 306. With this fitting structure, the concave fitting member 304 supports the convex fitting member 303 also in the X-axis direction. Therefore, although as shown in FIGS. 6A and 6B the shaft 301 is supported by the main body at only one position, the supporting structure can withstand up to a certain level of force of inclining the shaft 301 in the X-Y plane.

Since the convex fitting member 303 and the concave fitting member 304 are coupled to each other at only one position in the X-axis direction, when it is attempted to incline the shaft 301 in the X-Y plane, force does not act on the coupling portion by leverage. That is, even if force of inclining the shaft 301 in the X-Y plane is applied, the convex fitting member 303 is not prone to disengage from the concave fitting member 304.

For example, when the user makes an action of opening or closing the opening/closing member 103, force having a component in the X-axis direction in addition to components for the opening or closing may be applied to the opening/closing member 103. Even in such a case, in the structure of FIGS. 6A and 6B, the opening/closing member 103 does not come off easily.

Figure 7:
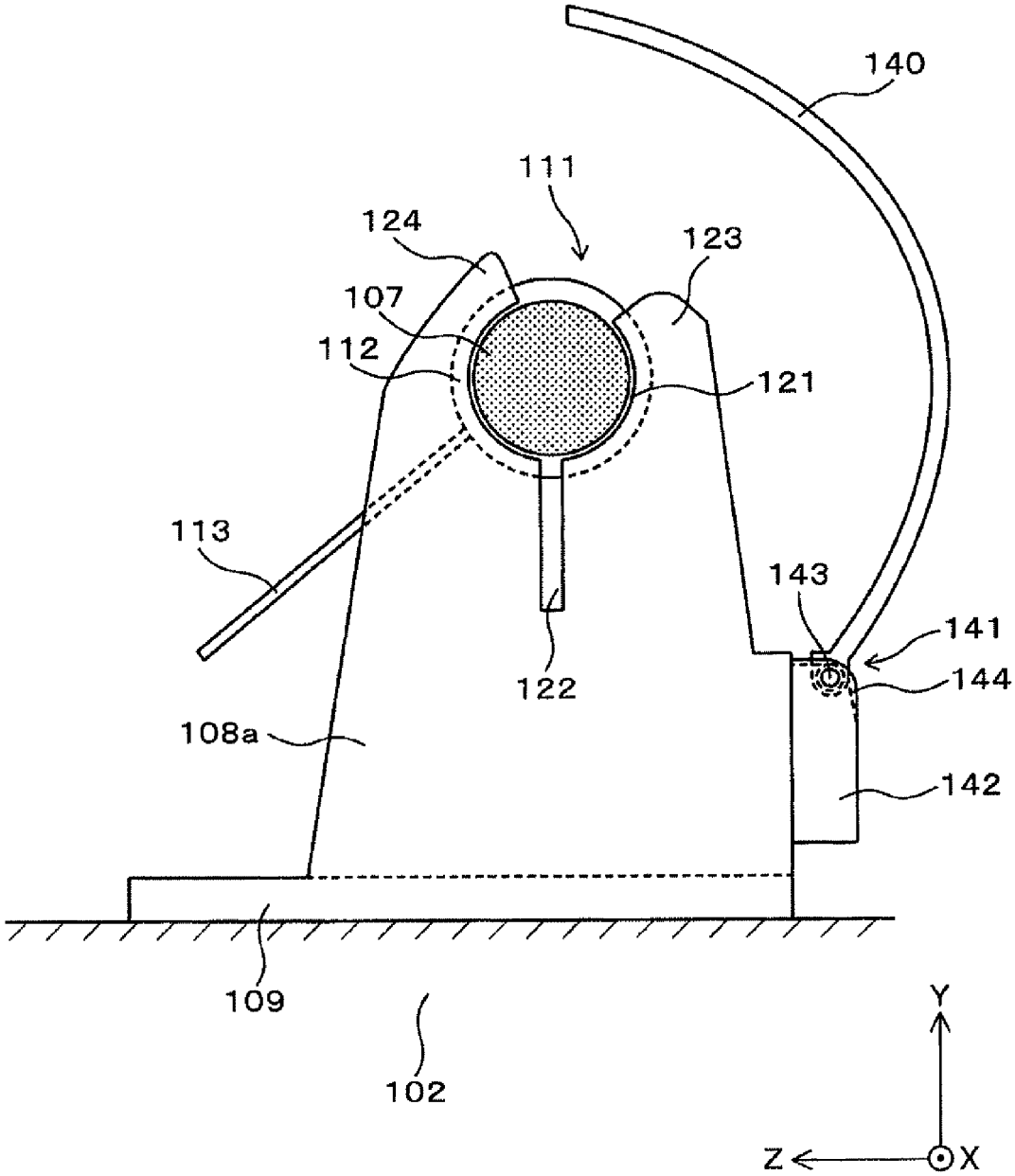
FIG. 7 is a conceptual diagram of another attachment structure for a fall preventing member.

A description will be made of a modification of the support structure for a fall preventing member. FIG. 7 is a schematic diagram of another support structure for a fall preventing member. In FIG. 7, the same reference numerals as used in FIG. 3 denote the same members and portions described in the first embodiment.

A fall preventing member 140 is shown in FIG. 7. The fall preventing member 140 is made of resin as in the case of the fall preventing member 114 used in the first embodiment and has the same shape as the fall preventing member 114. In the third embodiment, the fall preventing member 140 is attached to an attachment portion 142 by a hinge mechanism 141. The attachment portion 142 is a structural portion which is integral with the base 109.

In the hinge mechanism 141, a shaft 143 which is fixed to the fall preventing member 140 is supported rotatably by the attachment portion 142. The shaft 143 is inserted in a torsion coil spring 144. When the fall preventing member 140 is moved rightward (as seen in FIG. 7), repulsion force of the torsion coil spring 144 acts to return the fall preventing member 140 to the original position (the position of FIG. 7).

In the third embodiment, if the shaft 107 is pressed against the fall preventing member 140 in the state of FIGS. 4 and 5 in which the shaft 107 is disengaged from the shaft receivers 108*a* and 108*b*, the fall preventing member 140 is not only deformed elastically but also rotated clockwise (as viewed in FIG. 7) because of the action of the torsion coil spring 144. The force produced by the user's forcible action is thus absorbed and the fall preventing member 140 and its support structure are not prone to be damaged.

The invention is not limited to the above embodiments. In image forming apparatus, the invention can also be applied to, for example, an opening/closing portion of a portion where a recording sheet is supplied externally (manual feed), an opening/closing portion for replacement of an image forming unit in which a photoreceptor drum and a toner cartridge are integrated together, and an opening/closing portion of a lid of a portion that is provided with a connector for connection to a connection cable or an electronic recording medium (e.g., USB memory).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A lid device comprising:

a main body;

an opening/closing member that is attached to the main body so as to be opened and closed;

a support portion that is provided on the main body, and that supports the opening/closing member in such a manner which the opening/closing member is disengaged from the main body when receiving force of opening the opening/closing member beyond a predetermined opening/closing angular range; and a fall preventing member that prevents the opening/closing member disengaged from the support portion from coming off the main body.

2. The lid device according to claim 1, wherein the opening/closing member includes a rotary shaft which rotates when the opening/closing member is opened or closed, and the fall preventing member has a shape which surrounds the rotary shaft partially.

3. The lid device according to claim 1, wherein the fall preventing member is deformed elastically so as to return to an original state which is defined with respect to the main body.

4. The lid device according to claim 1, further comprising:

closing action preventing portion that disables an action of closing the opening/closing member which is disengaged from the support portion.

5. The lid device according to claim 1, wherein the support portion includes a recess and a spherical portion which is fitted in to the recess.

6. An image forming apparatus comprising:

a space in which a container containing an image forming material is disposed in a detachable manner, and the lid device according to claim 1, wherein the lid device closes the space with the opening/closing member, and the main body includes the image forming apparatus.

* * * * *